US006418840B1

(12) United States Patent
Viljanmaa

(10) Patent No.: US 6,418,840 B1
(45) Date of Patent: Jul. 16, 2002

(54) CALENDERING METHOD AND A CALENDER THAT MAKES USE OF THE METHOD

(75) Inventor: Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/402,212

(22) PCT Filed: Mar. 26, 1998

(86) PCT No.: PCT/FI98/00269

§ 371 (c)(1),
(2), (4) Date: Sep. 30, 1999

(87) PCT Pub. No.: WO98/44195

PCT Pub. Date: Oct. 8, 1998

(30) Foreign Application Priority Data

Apr. 2, 1997 (FI) ..... 971342

(51) Int. Cl.[7] ..... D21G 1/02; B30B 3/04

(52) U.S. Cl. ..... 100/38; 100/306; 100/311; 100/313; 100/153; 100/161

(58) Field of Search ..... 100/38, 306, 311, 100/313, 327, 331, 153, 155 R, 161, 173; 162/206, 207, 358.3, 358.4, 358.5

(56) References Cited

U.S. PATENT DOCUMENTS

| | | | | | |
|---|---|---|---|---|---|
| 3,804,707 A | | 4/1974 | Mohr et al. | | |
| 4,484,982 A | * | 11/1984 | Majaniemi | ..... | 162/358.3 |
| 4,596,633 A | | 6/1986 | Attwood | | |
| 4,976,820 A | * | 12/1990 | Laapotti | ..... | 162/206 |
| 4,998,333 A | | 3/1991 | Skyttä | | |
| 5,131,324 A | * | 7/1992 | Lassila et al. | ..... | 100/173 |
| 5,137,678 A | | 8/1992 | Hess et al. | | |
| 5,163,364 A | | 11/1992 | Bubik et al. | | |
| 5,483,873 A | * | 1/1996 | Koivukunnas et al. | ..... | 100/173 |

FOREIGN PATENT DOCUMENTS

| | | | | | |
|---|---|---|---|---|---|
| DE | 4344165 | | 6/1995 | | |
| EP | 0617165 | | 9/1994 | | |
| EP | 0698684 | | 2/1996 | | |
| FR | 2588293 | A1 * | 4/1987 | ..... | D21G/1/02 |
| JP | 54-46264 | A * | 4/1979 | ..... | D12G/1/00 |
| JP | 8-209582 | | 8/1996 | | |
| WO | WO-94/28239 | A1 * | 12/1994 | ..... | D21G/1/00 |

* cited by examiner

*Primary Examiner*—Stephen F. Gerrity
(74) *Attorney, Agent, or Firm*—Steinberg & Raskin, P.C.

(57) ABSTRACT

A calendering method and calender in which a web material is passed through a calender, the calender being defined by two rolls having resilient roll coatings and being loaded towards each other so that due to the resilient nature of the roll coatings an extended nip is defined. Each of the calendering rolls being covered by a flexible calendering belt that is non-compressible in comparison to the roll coatings and each of the calendering belts being formed into a endless loop by passing over a respective alignment or reversing roll.

23 Claims, 5 Drawing Sheets

PRIOR ART

PRIOR ART

CALENDERING METHOD AND A CALENDER THAT MAKES USE OF THE METHOD

CROSS REFERENCE TO RELATED APPLICATIONS

This is the national phase under 35 USC 371 of PCT international application no. PCT/FI98/00269 which has an international filing date of Mar. 26, 1998, which designated the United States of America.

FIELD OF THE INVENTION

The invention concerns a calendering method, in which the material web to be calendered, in particular a paper or board web, is passed through the calender, in which at least one calendering nip is formed by means of two rolls provided with resilient roll coatings, which rolls are loaded towards each other so that; owing to the resilient nature of the roll coatings, the nip between the rolls becomes an extended The invention also concerns a calender that makes use of the calendering method, which calender comprises at least one calendering nip, which is formed by means of two rolls provided with resilient roll coatings, and through which calendering nip the material web to be calendered, in particular a paper or board web, has been passed, in which connection the rolls provided with resilient roll coatings are loaded towards each other so that, owing to the resilient nature of the roll coatings, the nip between the rolls becomes an extended nip.

BACKGROUND OF THE INVENTION

When it is desirable to improve the standard of calendering, with the present solutions, in actual fact, the only possibility is to increase the number of calendering nips. This results in a more complicated construction of the calender and in more difficult control and tail threading of the paper web. Especially in the case of on-line machines, it must be possible to solve the contradictions arising from high running speed and from threading at full speed. Attempts have been made to solve these problems by means of various belt and shoe calenders, by whose means the calendering nip is extended and, thus, the operation of the nip is made more efficient. For example, in belt calenders, which in themselves are relatively recent constructions, the paper to be calendered is passed by means of an endless belt into a preliminary contact with a hot calender roll, in which case it is possible to create a steep temperature gradient, which is favourable from the point of view of calendering. By means of the belt, the effective length of the nip is increased, owing to the preliminary contact and because, as the belt material, it is possible to use considerably softer polymers than in roll coatings without problems arising from deformations related to heat. With a nip longer than in a supercalender or soft calender, the press impulse applied to the paper can be increased so that the pressure peak does not become excessively high and that the bulk does not start decreasing.

One belt calender solution has been described in the prior art, for example, in the Finnish Patent No. 95,061. A calender embodiment in accordance with said publication is illustrated schematically in FIG. 1A in the drawing, which figure represents the prior art. Thus, FIG. 1A is a schematic illustration of a prior-art calender, in which the calendering nip N is formed between a heatable hard roll 1 and a calendering belt, in particular a metal belt 5, supported by a roll 2 with resilient coating. The metal belt 5 is an endless belt, and its material can be, for example, steel. The belt is passed over a nip roll 2 provided with a resilient coating 3 and over a reversing roll 4. As was already stated above, in this prior-art calender, the calendering nip N is, thus, formed between a heatable hard roll 1 and said metal belt 5, which is supported by a calender roll 2 provided with a resilient coating. Such a solution is, in fact, quite extensively similar to a nip in a soft calender, in which, however, by means of the metal belt 5, both faces of the paper W can be subjected to a substantially equal treatment and, thus, the glazing can be made to take place at both sides of the paper W at the same time.

Further, FIG. 1B illustrates a further development of the prior-art calender as shown in FIG. 1A. In the illustration in FIG. 1B, the calender has been extended to be a calender with two nips, so that the calender comprises two heatable hard-faced calender rolls 1A and 1B, two calender rolls 2A, 2B provided with resilient roll coatings 3A, 3B, and an endless metal belt 5. The endless metal belt 5 is passed over said rolls 2A, 2B with resilient coatings, and said rolls with resilient coatings form calendering nips $N_1$, $N_2$ with the heatable hard-faced rolls 1A, 1B. More correctly, the calendering nips are formed, in each particular case, between the heatable hard-faced roll 1A, 1B and the metal belt 5, which metal belt 5 is loaded by means of a corresponding roll 2A, 2B with a resilient coating against the heatable hard-faced roll 1A, 1B. As is shown in FIG. 1B, the paper web W is passed through the first nip $N_1$, after which the web is spread and reversed by means of the take-out leading rolls 4A, 4B and guided into the second nip $N_2$. The construction and the operation of the rolls 2A, 2B with resilient coatings are similar to the illustration in FIG. 1A. The prior-art calenders as shown in FIGS. 1A and 1B are suitable for use with paper grades that do not require a long nip time to be glazed. Such paper grades are, for example, coated grades in which the glass transition temperature of the coating paste is low and in which, therefore, the glazing is rapid.

In view of on-line operation, a belt calender provides a significant advantage, among other things, in respect of the clear and linear running of the paper web, which again permits tail threading taking place at a high speed. In a belt calender supported by means of a glide shoe, the nip is formed between an endless belt and a steel roll. Owing to the glide shoe, the press zone becomes wider than in the belt calender described above. In a nip in a shoe calender, owing to the wider nip, the maximal pressure remains lower than in other present-day calenders, for which reason it is best suitable for paper grades in which retaining of the bulk has a high importance. As regards its construction, such a shoe calender is quite extensively similar to extended-nip presses, which have already been in use for a rather long time.

In respect of the prior art, as an example that represents shoe calendering, reference can be made, e.g., to the Published German Patent Application No. 43 44 165, wherein a smoothing method is described in which the fibrous web is passed in between two heatable faces which have been fitted at both sides of the web and which can be pressed against the web. The compression pressure can be regulated both in the running direction of the web and in the cross direction of the web in a way that has been chosen in advance. The prior art also includes the U.S. Pat. No. 5,163,364, which concerns a similar equipment provided with a glide shoe.

In respect of belt-supported calender concepts, reference is made additionally to the U.S. Pat. No. 4,596,633, in which a web finishing process is described, wherein the surface portions of the web to be finished are first moistened to a high degree of moisture (dry solids content 50% . . . 70%), and the web is then passed, on support of a belt, into a long finishing zone of low pressure, which zone comprises more than one roll nips. In said method, as the belt, prior-art paper machine fabrics are employed, such as felts, wires or polymer belts, while the surface treatment proper is applied exclusively to the side of the web placed facing the backup roll.

In surface treatment devices provided with a glide shoe, it can be considered that the, at least partly dragging, contact between the belt and the glide shoe is a problem, which contact applies quite a high strain both to the glide shoe and also to the belt. When a technology commonly employed in initial drying of a fibrous web has been applied, it has been realized that the quality of a belt that is well suitable for initial drying and that operates well in initial drying is inadequate in conditions of finishing of the web surface, in particular in respect of its resistance to the higher strains applied to the belt. Also, of course, the high local strains applied to the belt in web break situations are an almost equally important problem as in polymer-coated rolls, even though a similar polymer present in belt form tolerates considerably higher strains than a coating attached to a roll face rigidly does. In shoe calenders with solutions provided with a glide shoe and a belt, it is a further problem that the ends of the belt must always be closed, or spreading into the environment of the fluid and/or evaporation product employed in order to reduce the glide friction must be prevented in some other way.

A long belt circulation and a roll nip involve a similar basic problem. The quality of the belt face and a homogeneous inner structure are an unconditional requirement in order that a uniform quality of web surface could be achieved, and, moreover, keeping the long belt loops, which are made of a more or less elastic material and which often comprise more than one belt alignment rolls, in their position in the cross direction of the web requires the construction of a regulation system of remarkable complexity in connection with the finishing device.

OBJECTS AND SUMMARY OF THE INVENTION

The present invention concerns a calendering method and in particular a calendering method that makes use of a metal belt calender, in which, by means of endless metal belts, a calender with a very long nip is provided so that attempts are made to create all stages of the calendering process in one and the same calendering nip without unnecessary additional operations. Thus, the object of the invention is to provide a calendering method that has been improved substantially, as compared with the prior art, and a calender that operates in accordance with this improved method, by means of which calender the calendering process can be made readily controllable and by means of which method the construction of the calender that carries out the method can be made relatively simple. In view of achieving the objectives of the invention, the method in accordance with the invention is mainly characterized in that a flexible calendering belt, which is non-compressible in comparison with the roll coatings, which has been formed into an endless loop by means of alignment or reversing rolls or of equivalent rolls, and which runs through the nip, is passed over the calendering rolls provided with resilient roll coatings at each side of the nip.

On the other hand, the calender in accordance with the invention is mainly characterized in that a flexible calendering belt, which is non-compressible in comparison with the roll coatings, which has been formed into an endless loop by means of alignment or reversing rolls or of equivalent rolls, and which runs through the nip, has been passed over the calendering rolls provided with resilient roll coatings at each side of the nip.

By means of the invention, as compared with the prior-art calendering methods and calenders, a number of significant advantages are achieved, of which, for example, the following can be stated in this connection.

When, in the present invention, a flexible, thin and substantially non-compressible belt is used in a novel way together with rolls provided with compressible or non-compressible coatings, a very wide range of regulation of pressure is obtained together with a simultaneous range of high running speeds. Further, when a substantially non-compressible belt, whose material can be metal or, for example, a hard polymer, such as a fibre-reinforced resin, and a roll that is provided with a resilient coating and that supports said belt at the nip are employed, a resilient finishing zone is obtained which has a face of very high quality and which is adapted against the web face very well in compliance with the loading. Further, by means of the solution in accordance with the invention, a finishing device is provided in which the overall length of the web treatment zone is very long and, if necessary, includes a number of zones with different pressure ranges. An essential feature of a calender in accordance with the present invention is the hardness of the calendering belt that is used, as compared with the roll coating. This provides the highly significant advantage that tail threading is free of problems and easy, for the leader end of the web can be passed through the calender as of full width without a risk that the web that is possibly wrinkled or clodded during the threading might cause permanent damage to the resilient coatings. The further advantages and characteristic features of the invention will come out from the following detailed description of the invention.

BRIEF DESCRIPTION OF THE DRAWINGS

In the following, the invention will be described by way of example with reference to the figures in the accompanying drawing.

As was already slated above, FIG. 1B is a schematic illustration of a calender with two nips, in which the calendering nips are formed between hard rolls and a metal belt supported by rolls provided with resilient coatings.

DETAILED DESCRIPTION OF THE INVENTION

Figure 1A:
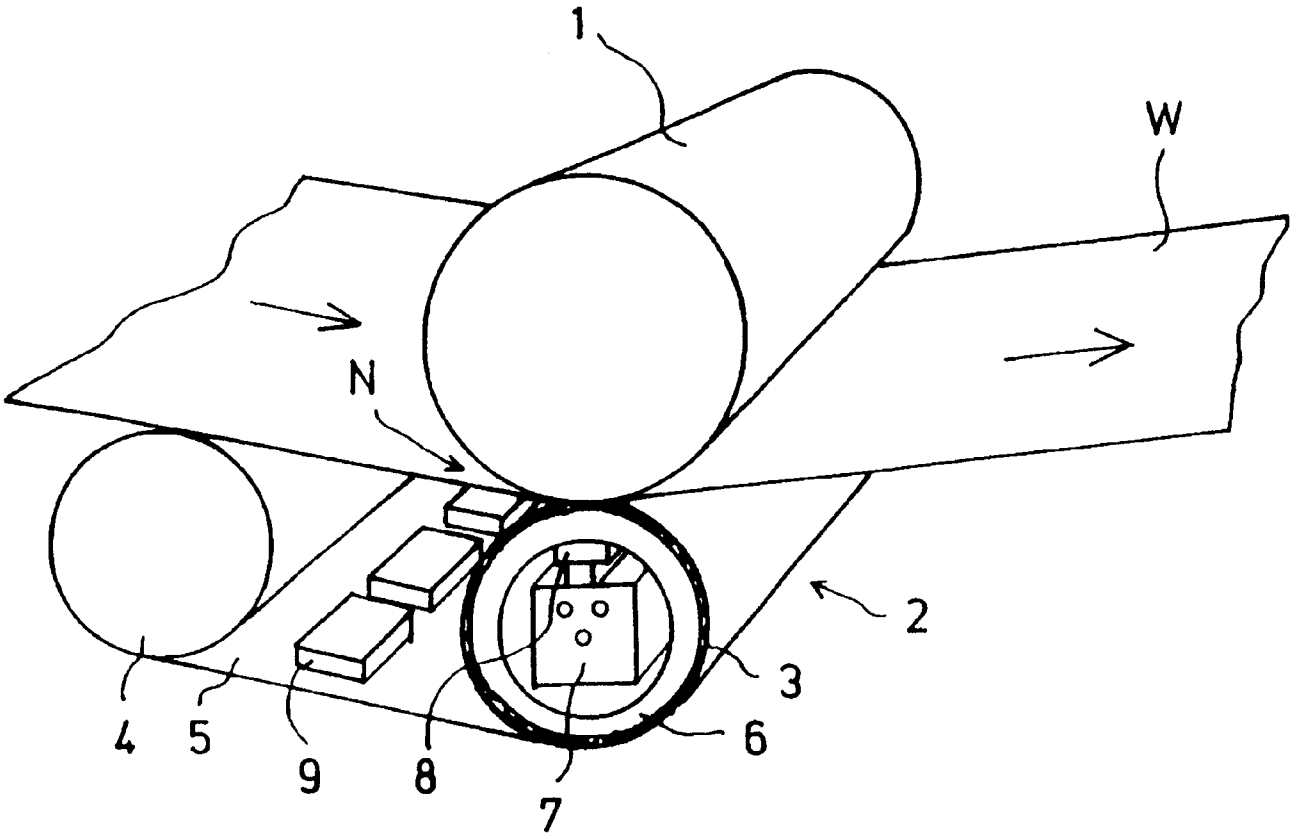
FIGS. 1A and 1B illustrate prior-art calenders so that FIG. 1A is a schematic illustration of a calendering nip which has been provided by means of a heatable hard roll and an endless metal belt that is supported by a roll provided with a resilient coating. On the other hand.

Regarding a calendering process in general, it can be stated that, in order that a paper could be made smooth and glazed from both sides, in the calendering nip there must be a smooth face against each side of the paper. When an on-line calender is concerned, two opposite hard steel rolls form an excessively narrow nip in order that a deformation of the desired nature had time to arise in the paper at a high running speed. When each of the hard-faced calender rolls is substituted for by an endless calendering belt supported by a roll provided with a resilient coating, in particular by a metal belt, a considerably extended nip is obtained, in which both sides of the paper are subjected to an equal treatment. The necessary pressing in the calendering nip is produced mainly by means of the rolls that support the calendering belts and partly by regulating the tension of the calendering belt. Depending on the requirement, the calendering belt can be supported either by hard rolls or by rolls provided with resilient coatings. The effect of a calendering belt supported by hard steel rolls on the paper is similar to that in a machine calender, which means that variations in thickness of the paper are calibrated efficiently. However, since the nip time is considerably longer than in a machine calender, owing to the contact between the paper and the calendering belt and owing to the rigidity of the calendering belt, it can be assumed that the desired visco-elastic deformation has time to take place to a greater extent than in an ordinary machine calender.

Steel belts supported against one another by means of rolls provided with resilient coatings subject the paper, at the rolls, to a press impulse similar to that in a supercalender. Also, in the area between the rolls, the paper is subjected to a press impulse arising from the tension of the belts, the function of said impulse being mainly to prevent reversing of the deformations that arose at the rolls. When rolls with resilient coatings are employed, the risk of damaging of the roll coatings is considerably lower than in a supercalender or soft calender, for the rolls are not in direct contact with the paper to be glazed, but the calendering belt protects the coatings efficiently from marking in the event of possible web breaks. The use of a calendering belt in a nip between the paper and a roll with resilient coating permits efficient cooling of the roll with resilient coating, which contributes to permitting a high running speed.

In the calendering process itself, the face of the paper to be calendered ought to be heated to a temperature higher than the glass transition temperature of the paper either before the calendering nip or, in an ideal case, in the nip itself. If the face of the paper has been heated in this way to the desired temperature, the face that presses the paper does not have to be hot any more, but the face can be preferably relatively cool, in which case, at the same time as the paper face in the soft state is pressed against the calendering face and becomes smooth, its temperature becomes lower, and the reversing of the deformation after the pressing is reduced. Such a solution, however, involves a certain contradiction, i.e. how to heat the face of the paper to such a high temperature so that the calendering faces in the calendering nip in contact with the paper face are not hot. Of course, the paper face can be heated in a cold nip if radiation energy is used for the heating and if the nip has been made of a material penetrable by said radiation.

Calendering can also be carried out as a so-called friction calendering, which is based, besides on the pressing of the paper placed between the faces, also on different speeds of the faces and the paper and on glide friction arising from said differences in speed. A normal copying arising from a press tension is intensified, besides owing to the rising of the temperature caused by the friction, also because the friction between the glazing face and the paper has been converted from static friction to kinetic friction, which is, as is well known, the lower one of these two. Even though, in the present-day solutions, gliding takes place in the machine direction only, the movement of the polymers is also facilitated in the cross direction because of the transition from the static friction to the kinetic friction. In the solutions employed so far, the friction has been produced by rotating the rolls that form the nip at a slight mutual difference in speed. The extent of gliding per unit of length has been very little, but an improvement of the final result can, however, have been noticed. Problems are mainly runnability and precise regulation of the speeds of rotation of the rolls. Friction calendering can also be employed in an extended-nip calender that makes use of a calendering belt. In such a calender, even with a very little difference in speed between the faces, the gliding to which the paper is subjected is considerably large because of the extended nip. Such gliding can be produced, for example, by rotating the opposite calendering belts at slightly different speeds. In addition to the general principles of calendering described above, the invention will be illustrated in the following with reference to FIGS. 1 to 3 in the drawing mentioned above with the aid of the particular alternative embodiments of the invention illustrated in said figures.

Figure 2:
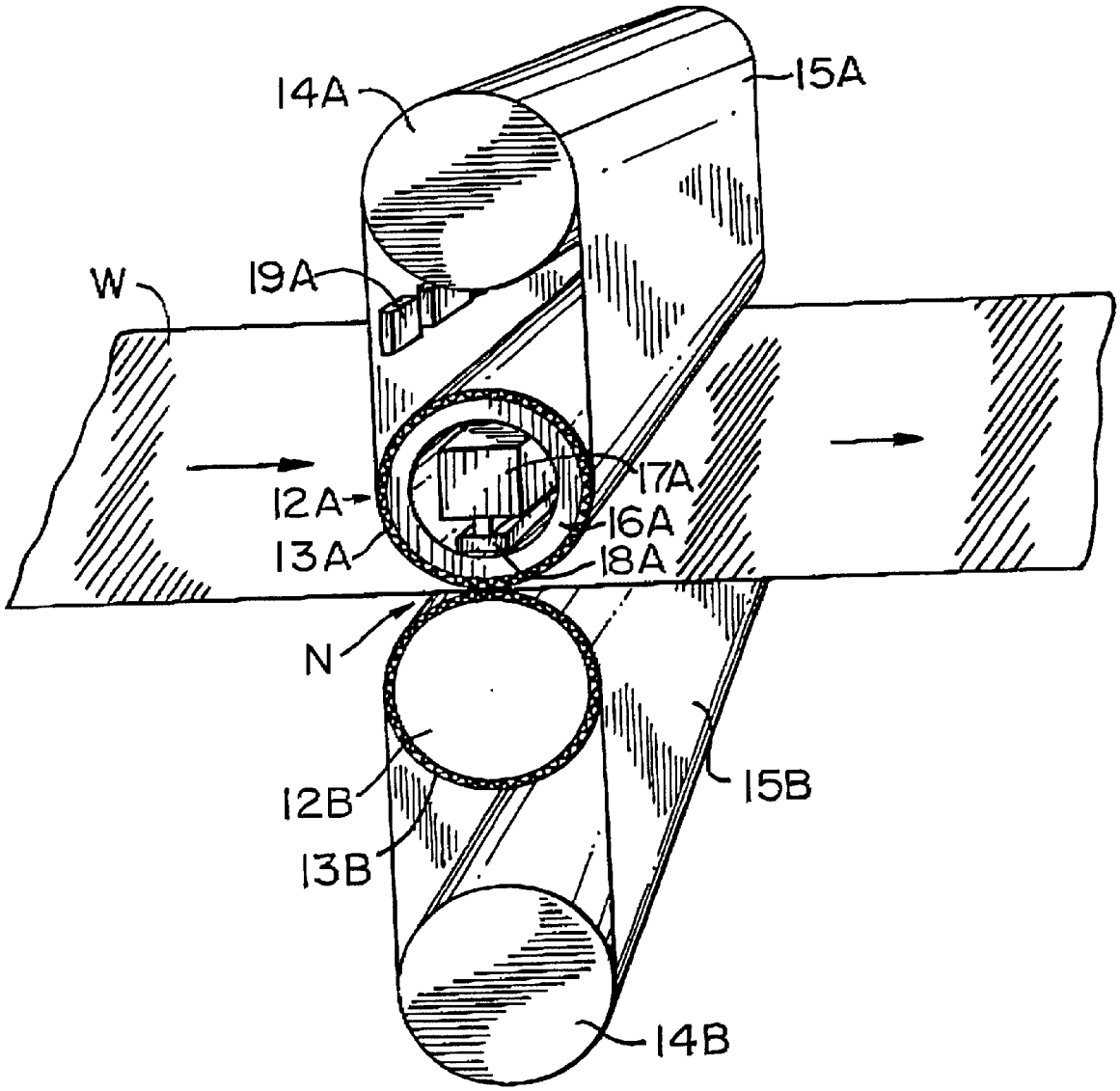
FIG. 2 is a schematic illustration of a calendering nip in accordance with the invention, which nip is formed between metal belts supported by means of rolls provided with resilient coatings at both sides of the nip.

FIG. 2 is a fully schematic illustration of a calender, in which the calendering nip N has been formed between two calendering belts 15A, 15B supported by rolls provided with resilient coatings. The calendering belts 15A, 15B are preferably metal belts, in particular steel belts, but it is an essential feature of the invention that the belts are flexible and smooth belts non-compressible in comparison with the roll coatings 13A, 13B on the rolls 12A, 12B with resilient coatings. As was already stated above, the material of the belts is preferably steel, but it is also possible to contemplate that, as the material of the belt, for example, a fibre-reinforced, hard polymer belt or an equivalent belt material is used. Thus, each of the endless calendering belts 15A, 15B is passed over a roll 12A, 12B provided with a resilient roll coating 13A, 13B and over a reversing roll 14A, 14B. In respect of their construction and principle of operation, the rolls 12A, 12B with resilient coatings 13A, 13B, or at least one of them, can be, for example, a self-loaded roll 12A adjustable in zones, in which the roll mantle 16A is arranged to revolve around a stationary roll axle 17A, the roll mantle 16A being loaded in relation to said axle towards the nip N by means of loading elements 18A. By means of such a roll adjustable in zones, the load in the nip N can be made uniform in the cross direction of the web, and, if desired, the load can be regulated if necessary. If one of the rolls with resilient faces is, for example, a roll 12A adjustable in zones, the roll 12B placed at the opposite side of the nip N does not necessarily have to be adjustable in zones in a similar way. In the case shown in FIG. 2, in view of achieving the desired calendering effect, the calendering belts 15A, 15B must be heatable, because the rolls 12A, 12B provided with resilient roll coatings 13A, 13B cannot be made heatable in a corresponding way. The heating of the calendering belts 15A, 15B can be carried out in a number of different ways, and as one of such ways, for example, induction heating can be mentioned. Induction heating can be employed if the belts are made of a metal material. In FIG. 2, the heating devices, in particular induction heaters, which heat the calendering belt 15A are illustrated fully schematically and denoted with the reference numeral 19A. Other modes of heating are, however, not excluded.

When the nip N has a width equal to that in a soft calender, at the same running speed and linear load, the paper web W is subjected to an equally high press impulse as in a soft calender. However, it is an advantage of the present invention, as compared with a soft calender, that at both sides of the paper there is a smooth hot metal face placed against the paper face, against which metal face the glazing can take place. Of course, in soft calenders, the primary function of the soft roll is just to make the nip longer and, thus, to increase the nip time. Glazing proper does not take place at the side of the soft roll almost at all, and therefore, in order to avoid unequalsidedness, in a soft calender at least two nips are needed, in which the roll positions are reversed in relation to one another.

Figure 1B:
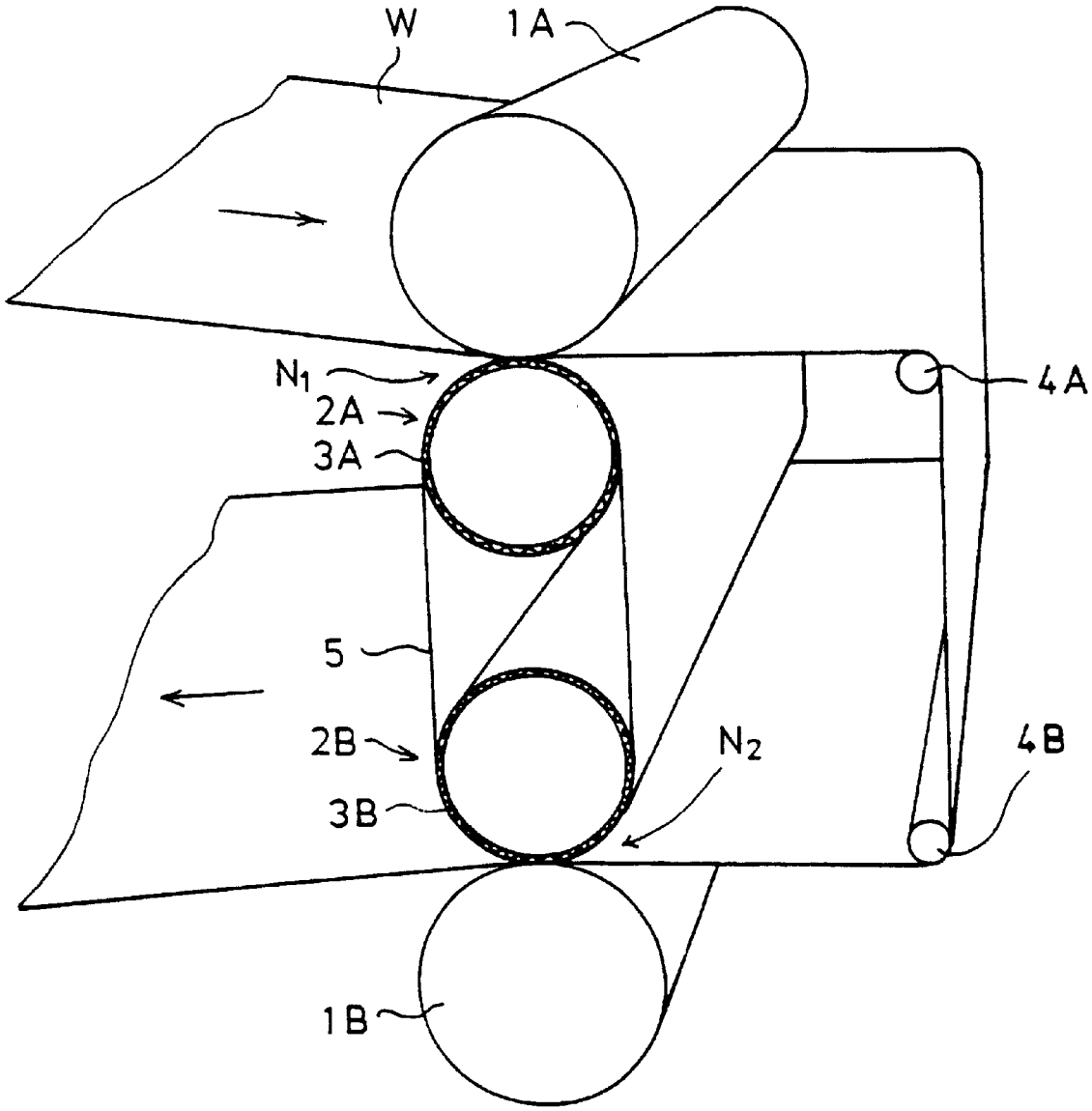

It is one of the significant differences of the calender in accordance with the invention illustrated in FIG. 2, as compared with the solutions illustrated in FIGS. 1A and 1B, which represent the prior art, that since the rolls 12A, 12B placed at both sides of the nip N are rolls provided with resilient coatings 13A, 13B, the geometry of the nip N becomes straight and the length of the nip N becomes longer than in the prior-art solutions shown in FIGS. 1A and 1B, in which prior-art solutions the shape of the nip complies with the curve form of the steel roll. Thus, also in the case of FIG. 2, the nip time becomes substantially longer than in the solutions shown in FIGS. 1A and 1B. From the point of view of the dimensioning of the calendering belt 15A, 15B, a straight nip N provides an advantage, for in it the calendering belt 15A, 15B just becomes straight when it enters into the nip N, and the curve direction is not reversed, as it is reversed in the case of FIGS. 1A and 1B. Thus, the improvement is significant in comparison with the prior art.

Figure 3:
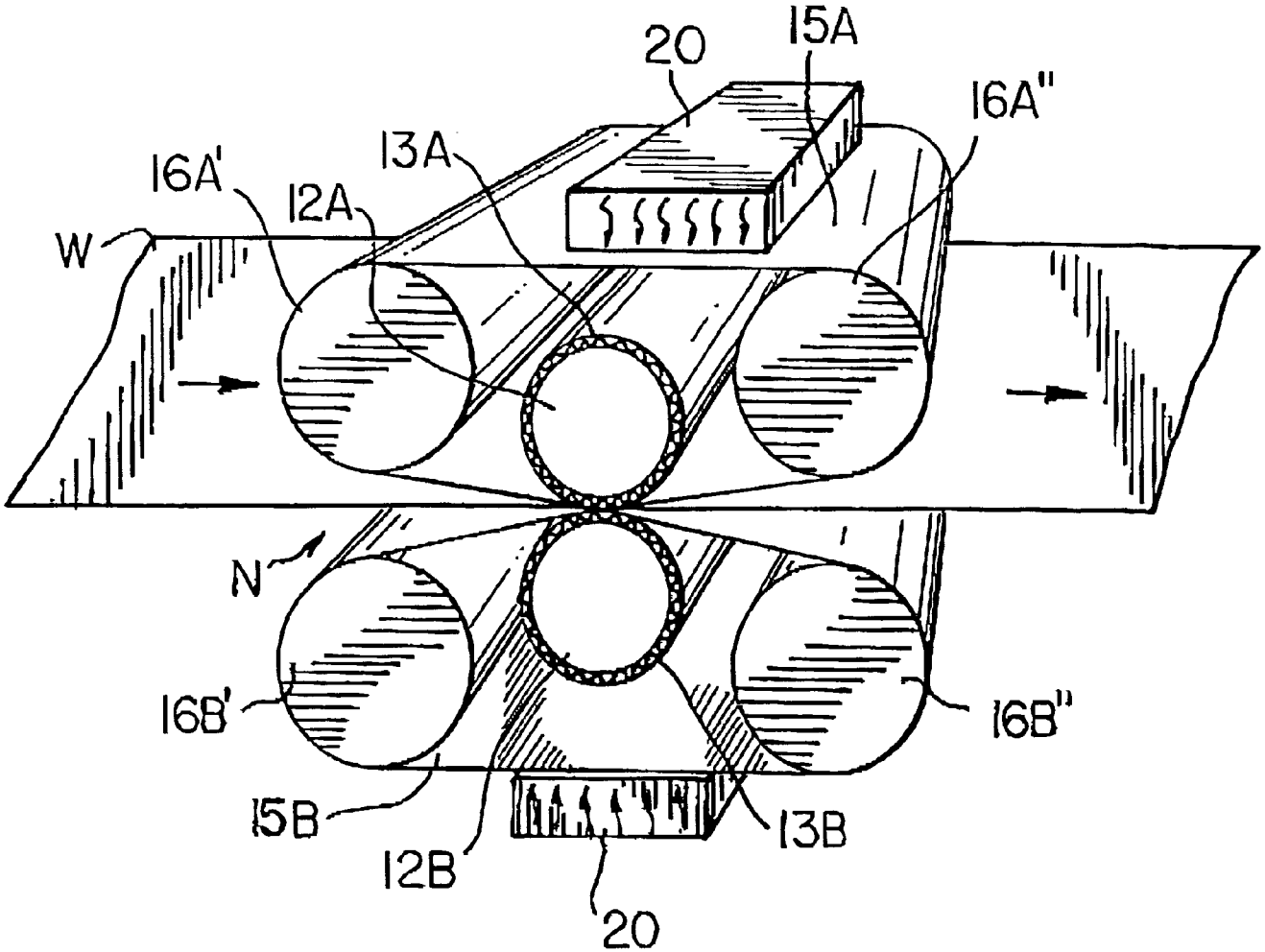
FIG. 3 illustrates a calender alternative to that shown in FIG. 2, in which calender the calendering nip is likewise formed between two metal belts supported by rolls provided with resilient coatings.

FIG. 3 shows a calender in which the calendering nip N through which the paper web W is passed is likewise formed between two calendering belts 15A, 15B supported by rolls with resilient faces. FIG. 3, however, differs from the solution of FIG. 2 in the respect that the calendering belts 15A, 15B are guided by means of alignment rolls 16A', 16A" and 16B', 16B", respectively, so that said calendering belts 15A, 15B are in contact with the resilient roll coating 13A, 13B in the nip N only. Such a solution is needed in particular if the formation of heat in the soft roll coatings 13A, 13B causes problems. Also in the case of FIG. 3, the calendering belts 15A, 15B have to be provided with purposeful heating devices 20 in order to achieve the desired temperature in the roll nip N. As the heating devices 20, it is possible to use, for example, induction heaters or equivalent. Since the roll coatings 13A, 13B on the rolls 12A, 12B that form the nip N are in contact with the hot calendering belt 15A, 15B at the nip N only, the roll coatings 13A, 13B can be cooled efficiently almost over the entire length of the coating. The construction and the operation of the rolls 12A, 12B can be, for example, similar to those described in connection with the preceding embodiment of the invention. The embodiments shown in FIGS. 2 and 3 are best suitable for use as calenders substituted for a soft calender.

Figure 4:
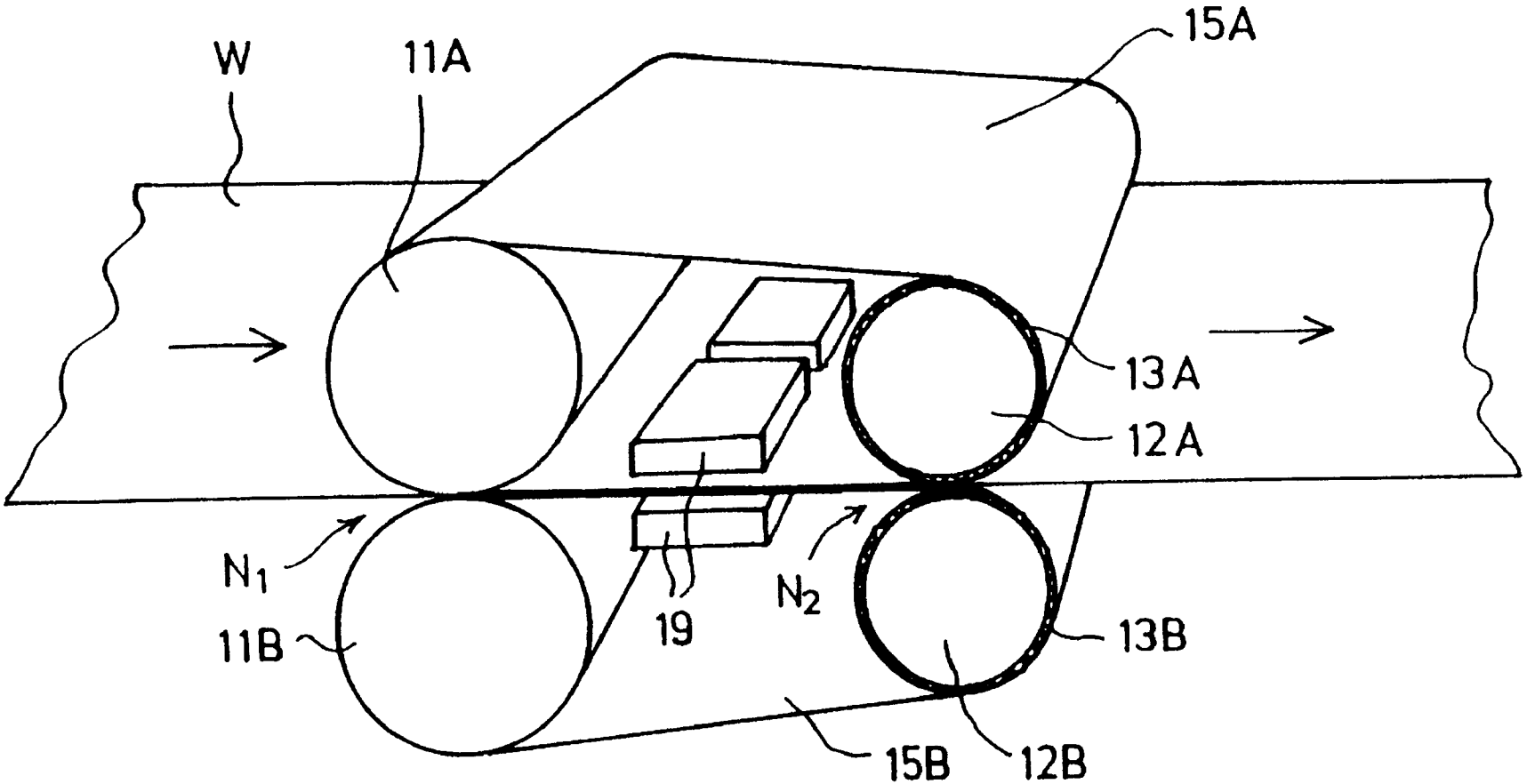
FIG. 4 is a schematic illustration of a calender that has been developed further from FIGS. 2 and 3 and by whose means a glazing in two stages can be carried out.

FIG. 4 shows an embodiment of a calender in which there are two calendering nips $N_1$ and $N_2$ placed one after the other. The first nip $N_1$ is formed between two hard rolls 11A, 11B, such as steel rolls. Said hard rolls 11A, 11B are preferably heatable rolls. The second nip $N_2$ is formed between two rolls 12A, 12B provided with resilient roll coatings 13A, 13B, however, so that endless calendering belts 15A, 15B have been passed over the hard rolls 11A, 11B and over the resilient-face rolls 12A, 12B placed at each side of the nips. Thus, the paper W runs between the nips $N_1$ and $N_2$ in a closed space between the calendering belts 15A, 15B. As compared with the prior art, this solution provides a significant advantage in particular in the respect that, in normal cases, after a hot nip, the paper is in the most troublesome state, in which connection a quick releasing of the pressure may spoil the whole paper. Now the pressure cannot be released quickly after the first nip, but, as was already described above, the paper runs between the calendering belts 15A, 15B on their support from the first nip $N_1$ into the second nip $N_2$.

When hard rolls, in particular heatable hard rolls are used as the pair of rolls 11A, 11B in the first nip $N_1$, in the nip $N_1$ it is possible to use a very high calendering pressure, in which case the effect is equal to a machine calender. At a high calendering pressure, the paper tends to be widened in the lateral direction, which again tends to produce cross-direction gliding between the paper and the calendering belt 15A, 15B. Cross-direction gliding improves the calendering of the paper W if the calendering belts 15A, 15B support the paper so much that folding of the paper is prevented. Such folding produces micro-tears in the paper web. The pair of rolls in the second nip $N_2$ consists of rolls 12A, 12B with resilient faces. Their function is, within a press zone wider than in the pair of rolls 11A, 11B and with a lower linear load, to finish the calendering result by applying a glazing effect similar to soft-calendering to both faces of the paper.

In the case of the first pair of rolls 11A, 11B, the calendering is almost exclusively based on compression of the paper. Between the nips $N_1$ and $N_2$, shear forces between the paper faces and the calendering belts 15A, 15B and the heat conducted from the calendering belts to the paper face are effective. In the portion of the paper web that has reached the area of the latter pair of rolls 12A, 12B, a temperature gradient has had time to be formed, so that the faces of the paper have been heated beyond the glass transition temperature of the polymers contained in the faces, and the primary calendering mechanism is copying of the face of the smooth calendering belt to the face of the paper. The formation of the temperature gradient can be regulated by varying the nip length and by thereby acting upon the time of dwell and by regulating the temperature of the calendering belts. Between the nips $N_1$ and $N_2$, inside the calendering belts 15A, 15B, actuators 19 may have been fitted, by whose means the calendering belts are either cooled or heated or high-frequency oscillation is produced in the calendering belts 15A, 15B.

In consideration of the calendering process, it can be stated further that, in particular in the case of a metal belt, the calendering belt can be heated. In the case of other materials, and also in the case of a metal material, the calendering belt can be, for example, cooled, moistened, etc., as required. Such a solution is very well suitable for one-sided calendering, in particular for calendering of board. In the calender, one belt can be heated and the belt placed at the opposite side of the nip can be cooled, in which case a phenomenon is produced in which the moisture present in the material web to be calendered can be made to be transferred in the calendering nip from the heated side to the cooled side. Earlier, it was already stated that one essential feature of the belt is its hardness in comparison with the roll coating. This provides the highly significant advantage that the threading is free from problems and easy, for the end of the web can be passed through the calender as of full width.

Above, the invention has been described just by way of example with reference to the figures in the accompanying drawing. The invention is, however, not confined to the exemplifying embodiments shown in the figures alone, but different embodiments of the invention may show variation within the scope of the inventive idea defined in the accompanying patent claims.

What is claimed is:

1. A calendering method comprising the steps of:

forming at least one calendering nip defined by two rolls, each of said rolls having a resilient roll coating;

loading each of said two rolls towards each other to form said nip between the rolls, the nip being an extended nip due to the resilient roll coating;

passing a first flexible calendering belt which is non-compressible in comparison to said roll coatings over a first one of said rolls and forming said belt into an endless loop by passing said first flexible calendering belt over a first loop defining roll; and passing a second flexible calendering belt which is non-compressible in comparison to said roll coatings over a second one of said rolls and forming said belt into an endless loop by passing said second flexible calendering belt over a second loop defining roll.

2. A calendering method as claimed in claim 1, further comprising:

heating at least one of said calendering belts to thereby produce a necessary calendering temperature and to plasticize a surface layer of a web material to be calendered.

3. A calendering method as claimed in claim 1, further comprising:

heating each of said first and second calendering belts to thereby calender a web material passing through the nip from both sides.

4. A calendering method as claimed in claim 1, wherein each of said first and second belts are constructed from metal and further comprising:

heating each of said first and second calendering belts by means of induction heating.

5. A calendering method as claimed in claim 1, further comprising:

heating one of said first and second calendering belts; and cooling an other one of said first and second calendering belts.

6. A calendering method as claimed in claim 1, further comprising:

regulating a length of the calendering nip by regulating a position of at least one said first and second loop defining rolls.

7. A calendering method as claimed in claim 1, wherein said first and second loop defining rolls are one of an alignment roll and reversing roll.

8. A calendering method as claimed in claim 1, wherein said first and second loop defining rolls are each hard rolls, said first and second loop defining rolls forming a nip with each other, whereby a web to be calendered is supported substantially over an entire distance between said calendering nip and said nip formed by said first and second loop defining rolls.

9. A calendering method as claimed in claim 8, further comprising:

heating one of said hard rolls to produce a desired calendering temperature.

10. A calendering method as claimed in claim 8, further comprising:

cooling at least one of said first and second calendering belts between said calendering nip and said nip formed by said first and second loop defining rolls.

11. A calendering method as claimed in claim 8, further comprising:

heating at least one of said first and second calendering belts between said calendering nip and said nip formed by said first and second loop defining rolls.

12. A calendering method as claimed in claim 8, further comprising:

producing a high frequency oscillation in said first and second calendering belts between said calendering nip and said nip formed by said first and second loop defining rolls.

13. A calender comprising:

at least one calendering nip defined by two calendering rolls, each one of said two rolls having a resilient roll coating, wherein each of said two rolls are loaded towards one another so that due to said resilient roll coatings an extended nip is defined;

a first flexible calendering belt which is non-compressible in comparison to said roll coatings;

a first loop defining roll;

a second flexible calendering belt which is non-compressible in comparison to said roll coatings;

a second loop defining roll;

wherein said first flexible calendering belt passes over a first one of said calendering rolls and said first loop defining rolls to thereby form an endless loop; and wherein said second flexible calendering belt passes over a second one of said calendering rolls and said second loop defining rolls to thereby form an endless loop.

14. A calender as claimed in claim 13, wherein at least one of said first and second calendering belts is heated to a necessary calendering temperature and to plasticize a surface of a web material to be calendered.

15. A calender as claimed in claim 13, wherein each one of said first and second calendering belts are heated to thereby calender a web material from both sides.

16. A calender as claimed in claim 13, wherein each one of said first and second calendering belts are constructed from metal and said belts are heated by means of induction heaters.

17. A calender as claimed in claim 13, wherein one of said first and second calendering belts are heated and the other one of said first and second calendering belts is cooled.

18. A calender as claimed in claim 13, wherein at least one of said first and second loop defining rolls is structured and arranged to be moveable to thereby enable an adjustment of a length of said calendering nip.

19. A calender as claimed in claim 13, wherein said first and second loop defining rolls are hard rolls and said first and second loop defining rolls define a nip between one another whereby a web to be calendered is supported substantially over an entire distance between said calendering nip and said nip formed by said first and second loop defining rolls.

20. A calender as claimed in claim 19, wherein at least one of said hard rolls is heatable in order to produce a desired calendering temperature.

21. A calender as claimed in claim 19, wherein at least one of said calendering belts is provided with a cooling device arranged in an area between said calendering nip and said nip formed by said first and second loop defining rolls.

22. A calender as claimed in claim 19, wherein at least one of said calendering belts is provided with a heating device arranged in an area between said calendering nip and said nip formed by said first and second loop defining rolls.

23. A calender as claimed in claim 19, wherein said calendering belts are provided with devices adapted to produce a high-frequency oscillation in said belts in an area between said calendering nip and said nip formed by said first and second loop defining rolls.

* * * * *